US005346067A

United States Patent [19]

Haufe et al.

[11] Patent Number: 5,346,067

[45] Date of Patent: Sep. 13, 1994

[54] PACKAGE FOR INDIVIDUAL OBJECTS WITH END PIECES HAVING TUBULAR FILM ATTACHED THERETO

[75] Inventors: Wilfried Haufe; Herbert Kajnath, both of Neu-Isenburg, Fed. Rep. of Germany

[73] Assignee: E. I. du Pont de Nemours and Company, Wilmington, Del.

[21] Appl. No.: 64,087

[22] Filed: May 21, 1993

[30] Foreign Application Priority Data

Nov. 29, 1990 [DE] Fed. Rep. of Germany ..... 4038011

[51] Int. Cl.[5] ..... B65D 71/08; B65D 85/42

[52] U.S. Cl. ..... 206/497; 206/408; 206/410; 206/413; 206/419

[58] Field of Search ..... 206/407, 408, 410, 413–416, 206/497, 419, 45.33

[56] References Cited

U.S. PATENT DOCUMENTS

| | | | |
|---|---|---|---|
| 2,754,959 | 7/1956 | McCarty | 206/45.33 |
| 3,322,263 | 5/1967 | Gulliver | 206/497 X |
| 3,399,761 | 9/1968 | Hayashi . | |
| 3,669,255 | 6/1972 | Raymus | 206/497 X |
| 3,837,480 | 9/1974 | Brunett | 206/497 |
| 3,961,707 | 6/1976 | Lehr et al. | 206/419 |
| 3,983,997 | 10/1976 | Warshaw | 206/413 X |
| 4,306,653 | 12/1981 | Fales | 206/497 X |
| 4,708,246 | 11/1987 | Minion | 206/416 X |
| 4,792,044 | 12/1988 | Nishizawa et al. | 206/408 X |
| 4,955,471 | 9/1990 | Hirose et al. | 206/497 X |
| 4,988,001 | 1/1991 | Brandsletter et al. | 206/415 X |

FOREIGN PATENT DOCUMENTS 8908917 12/1989 Fed. Rep. of Germany .

*Primary Examiner*—Bryon P. Gehman
*Attorney, Agent, or Firm*—Thomas H. Magee

[57] ABSTRACT

A package for an object includes a support component extending axially to the object, and two end pieces resting, respectively, on the ends of the support component and projecting beyond the cross-section of the object. The package also includes a tensioned tubular film which is joined with the end pieces to create a union therewith and fix the end pieces in their position. The tubular film is attached in grooves or recesses encircling the circumference of the end pieces by a positive or a frictional joint.

23 Claims, 8 Drawing Sheets

PACKAGE FOR INDIVIDUAL OBJECTS WITH END PIECES HAVING TUBULAR FILM ATTACHED THERETO

This application is a Rule 371 of International application PCT/US91/08753, filed Nov 27, 1991.

BACKGROUND OF THE INVENTION

The invention concerns a package for individual objects.

Known packages for objects vulnerable to mechanical forces, e.g., electronic devices, consist of two end pieces and a sufficiently large box. The end pieces made, for example, of rigid foam are put at each end, oriented to one axis of the object, and this assembly is inserted into the box. Because the cross-sections of the end pieces project beyond that of the object, the latter is held in such a way that it does not contact the inner walls of the box. If required, space between the end pieces and the box inner walls is filled by inserts, e.g., of rigid or flexible foam. A filler may also be inserted in the space between the object and the inner wall of the box. This package is stabilized by the fact that the object itself axially supports the end pieces while the box, together with the inserts, prevents axial motion of the end pieces.

Packages for a rolled-up web of light-sensitive material are also known from widespread use. These consist of a core, two end pieces, a box and, if appropriate, inserts. The box is configured as a telescoping or folding box. In the packaging procedure the web is first wound on the core, the end pieces are attached to the core, and ultimately this assembly is inserted into the box. Stability of these packages is of the same type as described above, in that the end pieces are supported on the core and are firmly held in this position by the box.

A longitudinal section of such a known package is shown as an example in FIG. 1. The object to be packaged is a roll (1) of photopolymer resist film that is wound on a polystyrene core (2). To protect the resist film that is vulnerable to mechanical damages, on its front sides the film roll (1) has spacers (6) of elastic material, and rigid end spacers (7), that fill the difference in length between roll (1) and roll core (2) and seal off the front side of the film roll (1). A sheet of pigmented polyethylene (3) that is impermeable to light is loosely wrapped around the roll to protect it from light. Fixed on the ends of the core (2) are rectangular-shaped end pieces (4) that have round projections (5) which fit into the core. The core (2) and its end pieces are put in the interior (10) of a paperboard telescoping box with a rectangular cross-section matching that of the end pieces. Excess length of the box is filled with inserts (8). The outer part (9) of the box is joined with the inner part by adhesive tape. In this type of package, the end pieces (4) are fixed relative to the core (2) by the box pieces (10, 9) and the inserts (8). The resist film wound on the core is thus held at a distance from the inner side of the box, protecting it from damage by force on the box.

In many respects, packages of this type are unsatisfactory. For example, it is difficult to automate insertion of the object with its end pieces into the box. The boxes require a relatively high pre-manufacturing expense, and take up a great deal of room in shipping and storage. Hence their return for re-use is not economical, and after use they constitute a bulky mass to dispose of. In packaging objects that differ only in axial length, various sizes of boxes must be kept in inventory; small differences in length can be handled with inserts. An example is the packaging of light-sensitive material in rolls of differing width.

U.S. Pat. No. 3,837,480 discloses a package for wide, thin film printer ribbon. The package includes a pair of generally butterfly-shaped end pieces of substantially uniform thickness having integral bosses extending orthogonally and inwardly therefrom. A groove surrounds each boss for press fitting thereunto the open ends of a ribbon supply roll and a ribbon leader roll, a span of the ribbon being exposed between the two spaced-part rolls. A heat-shrinkable overwrap encompasses the package and the end pieces have break open cavities in their outer walls for permitting the heat-shrunk overwrap to be broken without danger of damaging the film ribbon.

The objective of the invention is to create a package suitable for fully automatic packaging of individual objects, which is simpler and less expensive than the state of the art, can be adapted easily to articles of different lengths, and can be assembled exclusively from compact, re-usable parts and recyclable material.

SUMMARY OF THE INVENTION

The present invention comprises a package for an object including a support component extending axially to the object, and two end pieces resting, respectively, on the ends of the support component and projecting beyond the cross-section of the object. The package includes a covering, for fixing the end pieces in position, comprising a tensioned tubular film joined with the end pieces to create a union therewith.

DETAILED DESCRIPTION OF THE PREFERRED EMBODIMENTS

Figure 1:
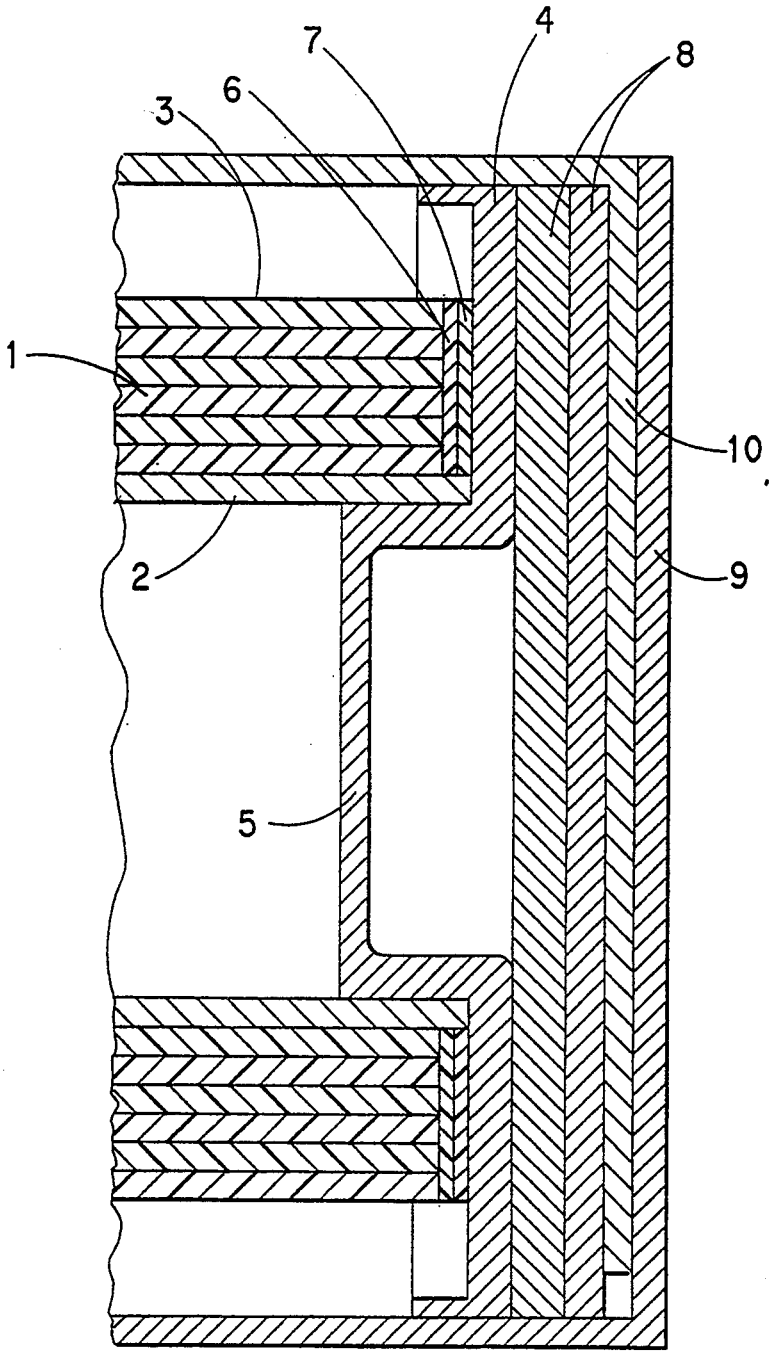
FIG. 1 is a longitudinal cross-section of a state-of-the-art package for a roll of photopolymer film.
Figure 2:
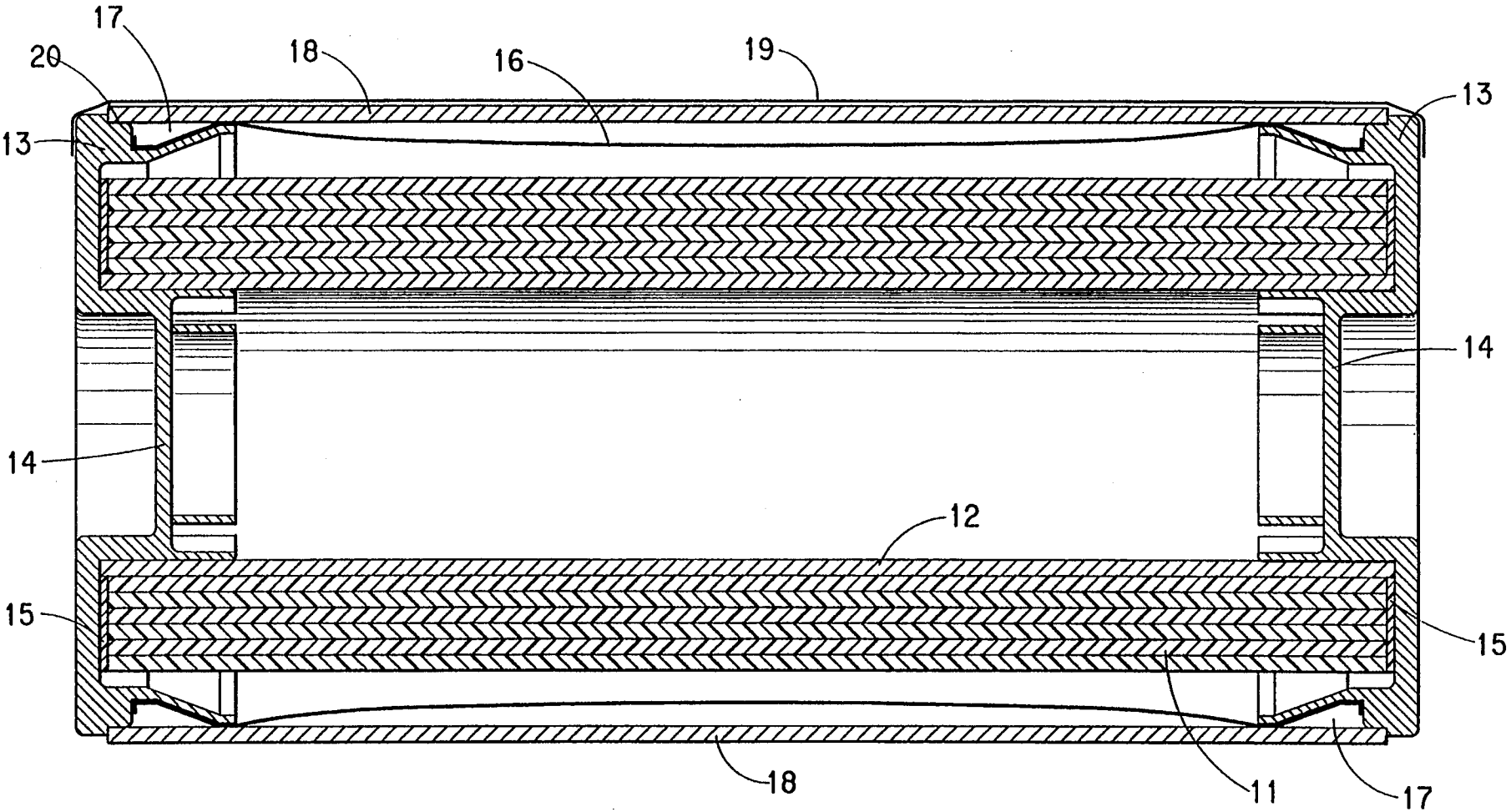
FIG. 2 is a longitudinal cross-section of the package of the invention for a roll of a light-sensitive material.

FIG. 2 shows a light-sensitive material configured as a web (11) rolled up on a core (12). At the ends of the core (12) that project somewhat beyond the faces of the rolled-up web (11) there are end pieces (13) that have a square cross-section. These end pieces have protrusions (14) that engage in the axial aperture of the core, thus preventing the end pieces from moving radially, relative to the core. Between the roll faces of the web (11)

and the opposing surfaces of the end pieces (13) there are elastic disks (15) that protect the faces from damage. Between the end pieces ( 13 ) is tensioned a shrink film tubing (16), the ends of which are shrunk into peripheral grooves (17) in the end pieces, thus creating a positive union with them. The disks (15) may be pressed against the front sides of the film roll by the tension of the film tubing (16), and elastically conform to them. This prevents, for example with photopolymer films, escape of light-sensitive material caused by cold flow. The end pieces (13) are axially fixed by the core and the film. Surrounding this configuration is a sheath (18) that is creased from a rectangular paperboard blank, closed by a longitudinally extending adhesive tape (19), and secured to the end pieces. It rests in additional peripheral recesses (20) in the end pieces (13).

Figure 3:
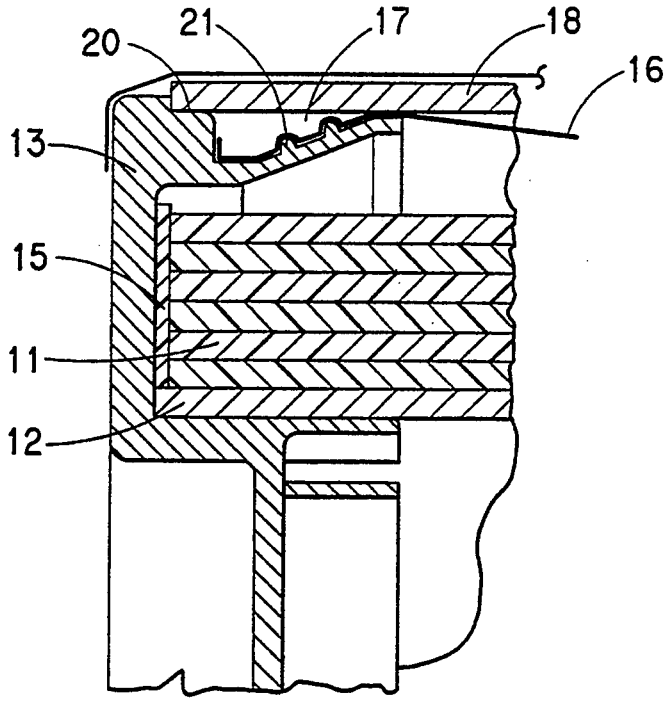
FIG. 3 is an enlarged view of the end of the package shown in FIG. 2, in longitudinal perspective.

FIG. 3 is an enlarged section of one end of the package of FIG. 2. Elevations (21) within the peripheral groove (17) strengthen the positive union between the shrunken tubing (16) and the end piece (13), so that the tubing cannot slip off the end piece (13), because of its tension. In this configuration, the material of the sheath (18) is advantageously so thick that it projects somewhat from the peripheral recess (20). Because of this, when several packages are stacked the end pieces (13) cannot meet; thus no stresses are transmitted to the rolls that might damage them.

Figure 4:
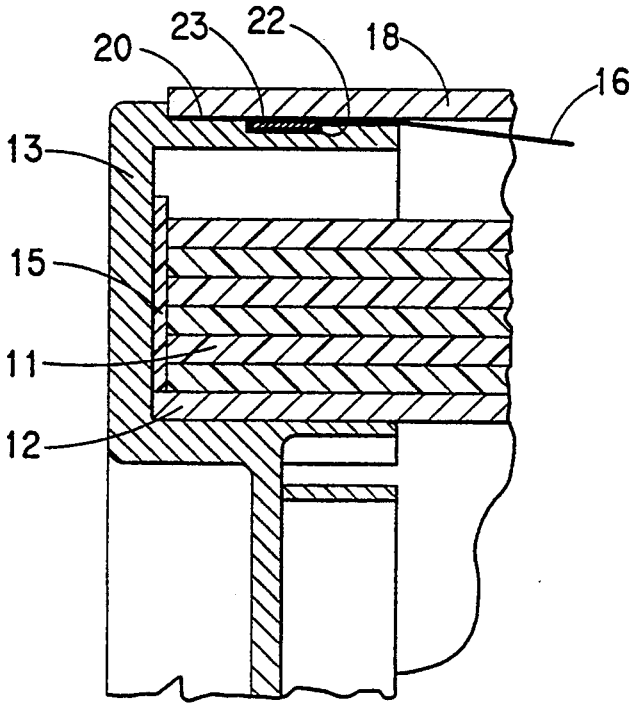
FIG. 4 is another version of an end piece of the package shown in FIG. 3.

FIG. 4 shows another configuration of the end piece (13) for the package described above. Instead of the peripheral groove (17), this end piece has a flat peripheral recess (22) in which the end of the the film tubing (16) is inserted. A peripheral tape (23) forces the tubing (16) against the end piece and secures it there, mainly by friction.

Figure 5:
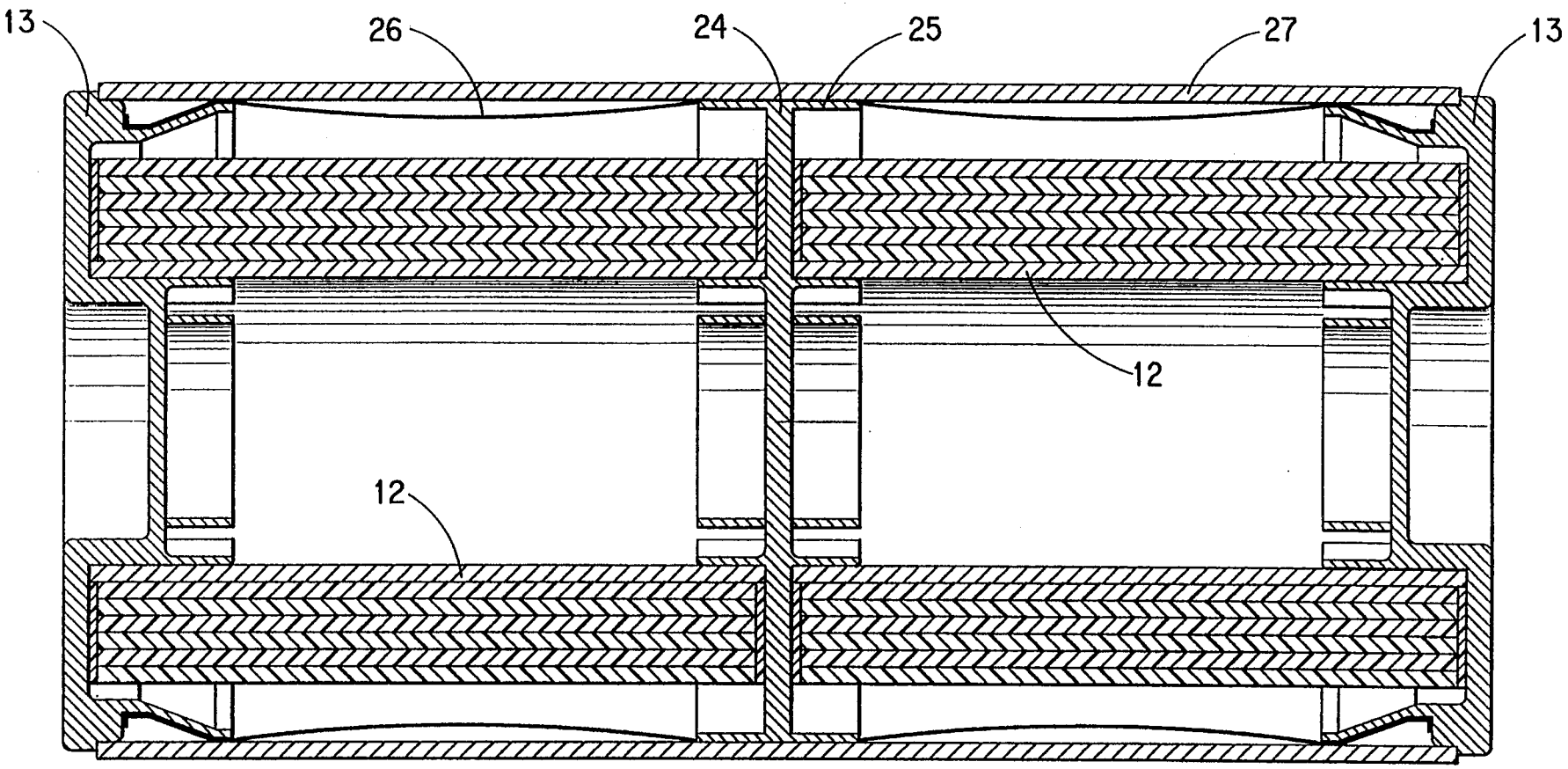
FIG. 5 is a longitudinal cross-section of a package of the invention for two sequentially arranged rolls of a light-sensitive substance.

FIG. 5 is a longitudinal section of a package for two rolls of about the same diameter arranged along the same axis sequentially. Compared to the previously described package for an individual item, its only additional component is a spacer (24) also of rectangular section when viewed from the side, on which the inner ends of the roll cores (12) rest. The film tubing (26) and the sheath (27) both extend over the two rolls and the spacer, from one end piece (13) to the other. They are supported by a circumferential edge (25) of the spacer (24).

Figure 6:
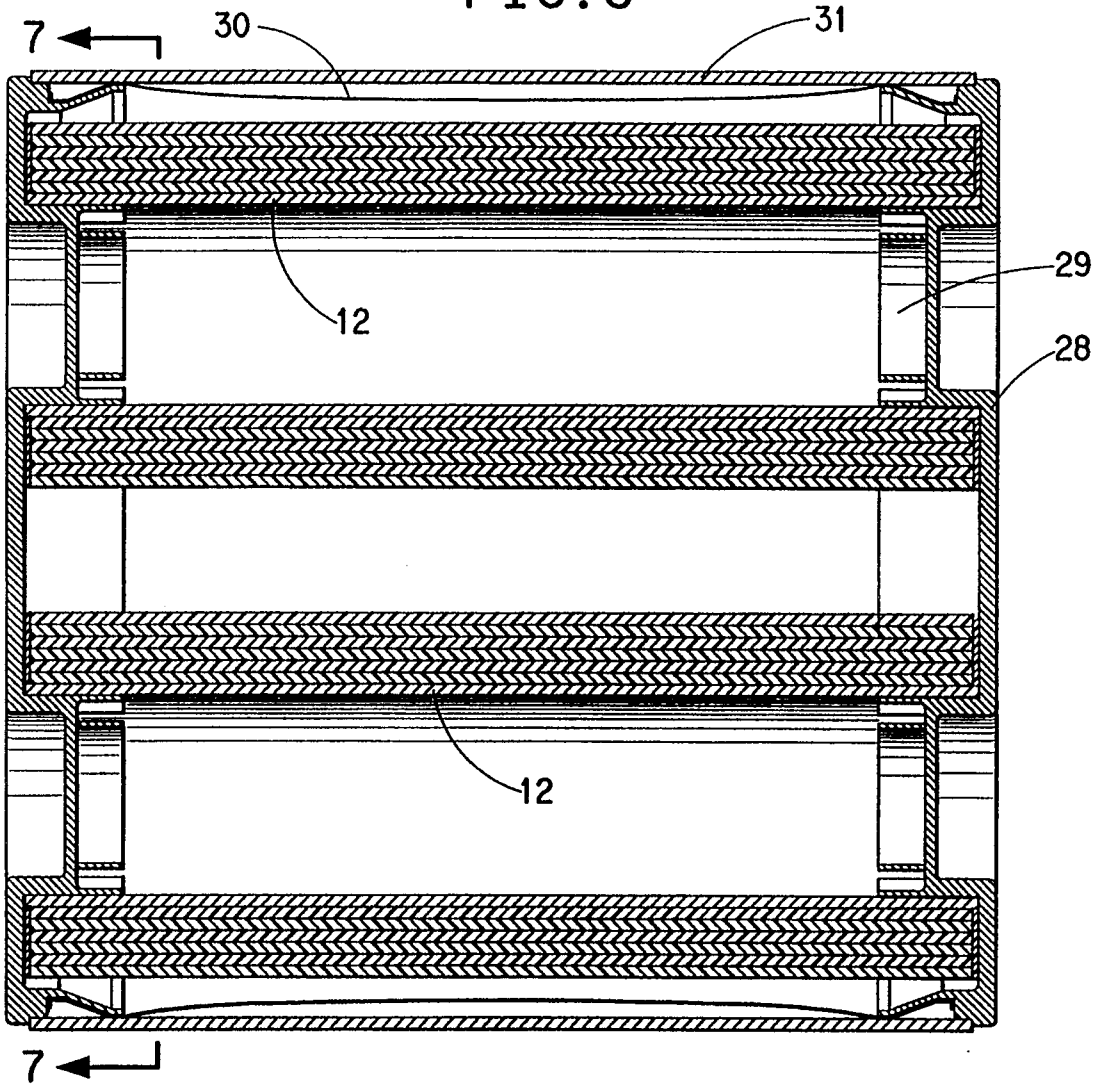
FIG. 6 is a longitudinal cross-section of a package of the invention for two rolls of a light-sensitive substance, arranged side by side.

A longitudinal cross-section of a package for two side by side rolls of the same length is shown in FIG. 6. In this configuration, the ends of the roll cores (12) rest on double end pieces (28) and are secured against radial movement by protuberances (29). The arrangement of the film tubing (30) and sheath (31) are totally similar to that for packaging individual objects.

Figure 7:
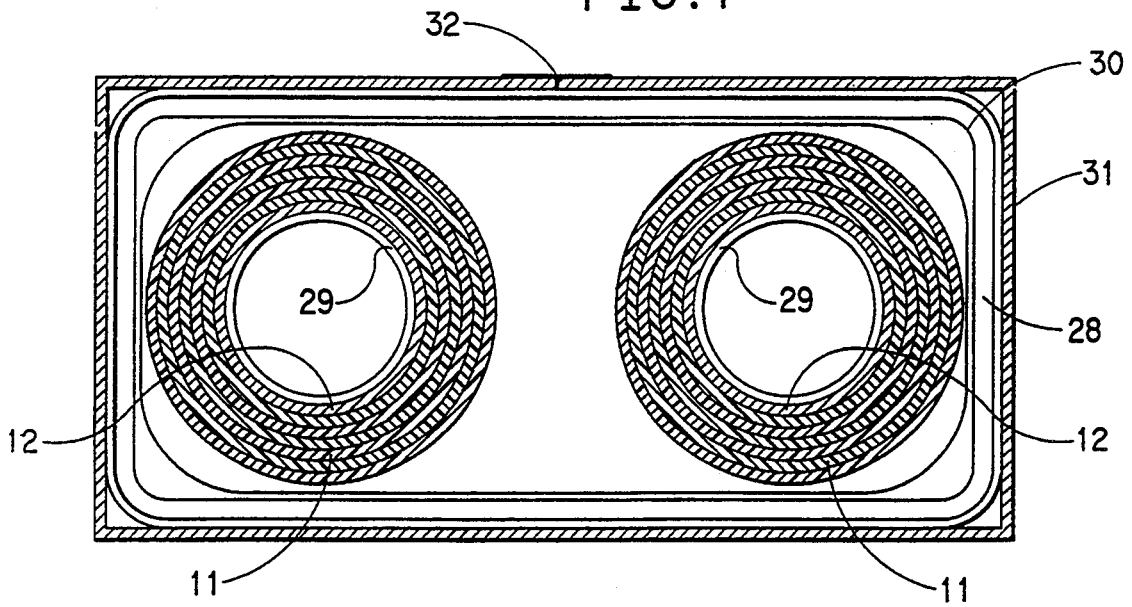
FIG. 7 is a cross-section of the package of FIG. 6.

FIG. 7 is a cross-sectional view of this package. The prismatic sheath (31) is a rectangular cardboard blank bent at the edges, and is sealed with adhesive tape (32).

Figure 8:
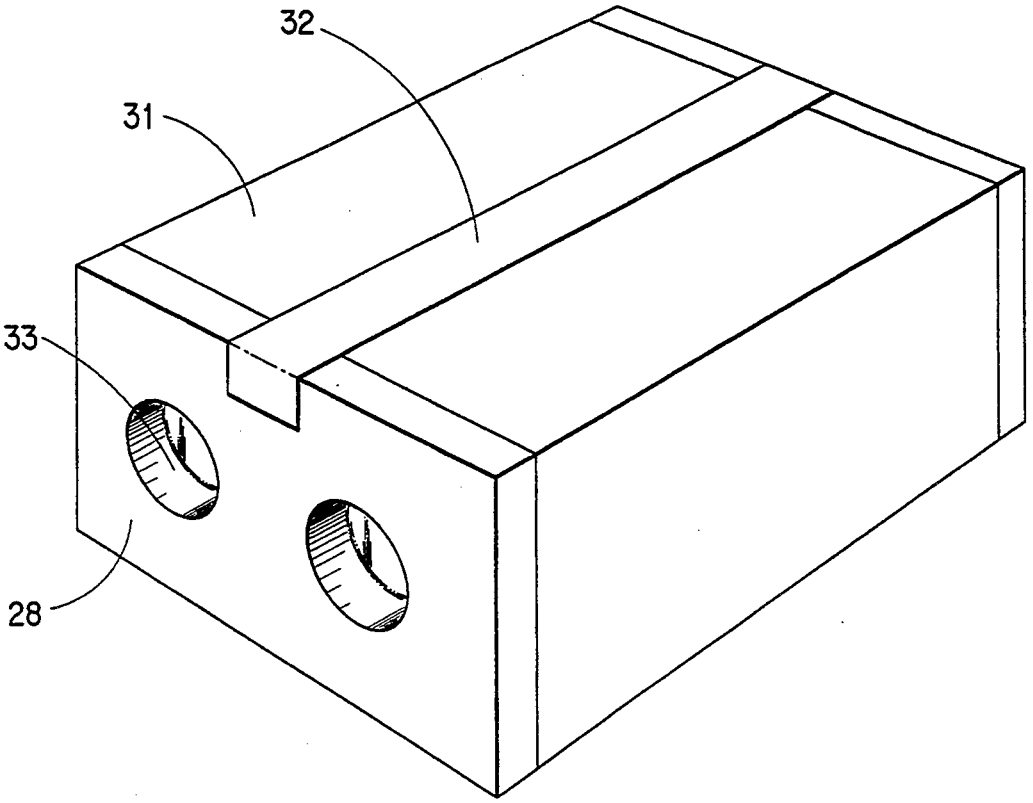
FIG. 8 is an exterior perspective view of the package of FIG. 6.

The exterior of this package is seen in FIG. 8, which shows the double end pieces (28) and the sheath (31) that is sealed with adhesive tape (32) and secured to the end pieces (28). The protuberances (29) mate with depressions (33) to facilitate handling the package.

Figure 9:
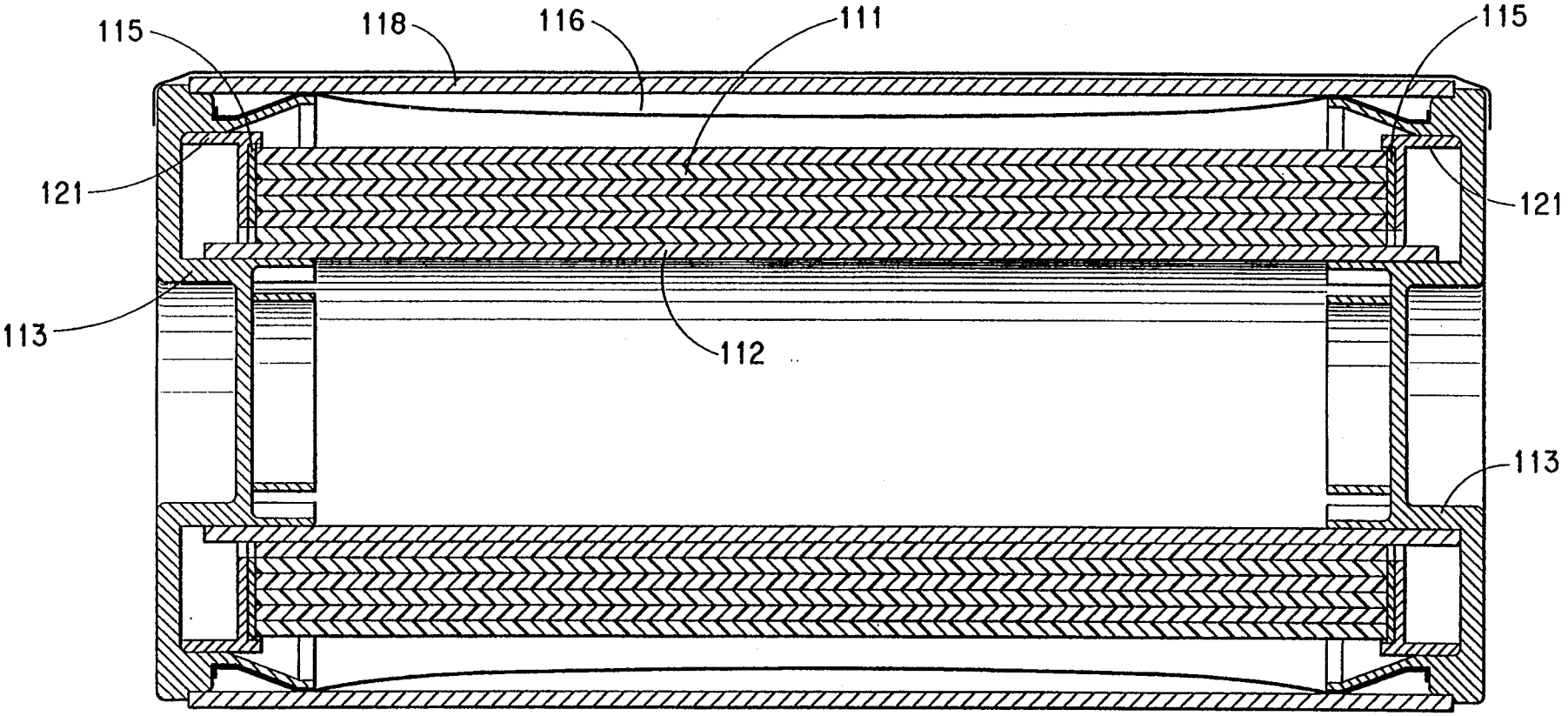
FIG. 9 is another package for a roll of light-sensitive material, shown in longitudinal cross-section.

FIG. 9 illustrates another preferred modification of the individual package shown in FIG. 2. Compared with FIG. 2, the numbers designating components are increased by 100. In this arrangement, the support component is not the roll core (112) but the roll (111), together with annular adapters (121) and gasket rings (115). The force generated by the tensioned film tubing (116) is exerted through the end pieces (113), adapters (121) and gasket rings (115) on the outer sides of the roll (111). This seals the cut edges of the photopolymer film web, prevents escape of the light-sensitive substance by cold flow and keeps individual layers of the roll from adhering together.

Figure 10:
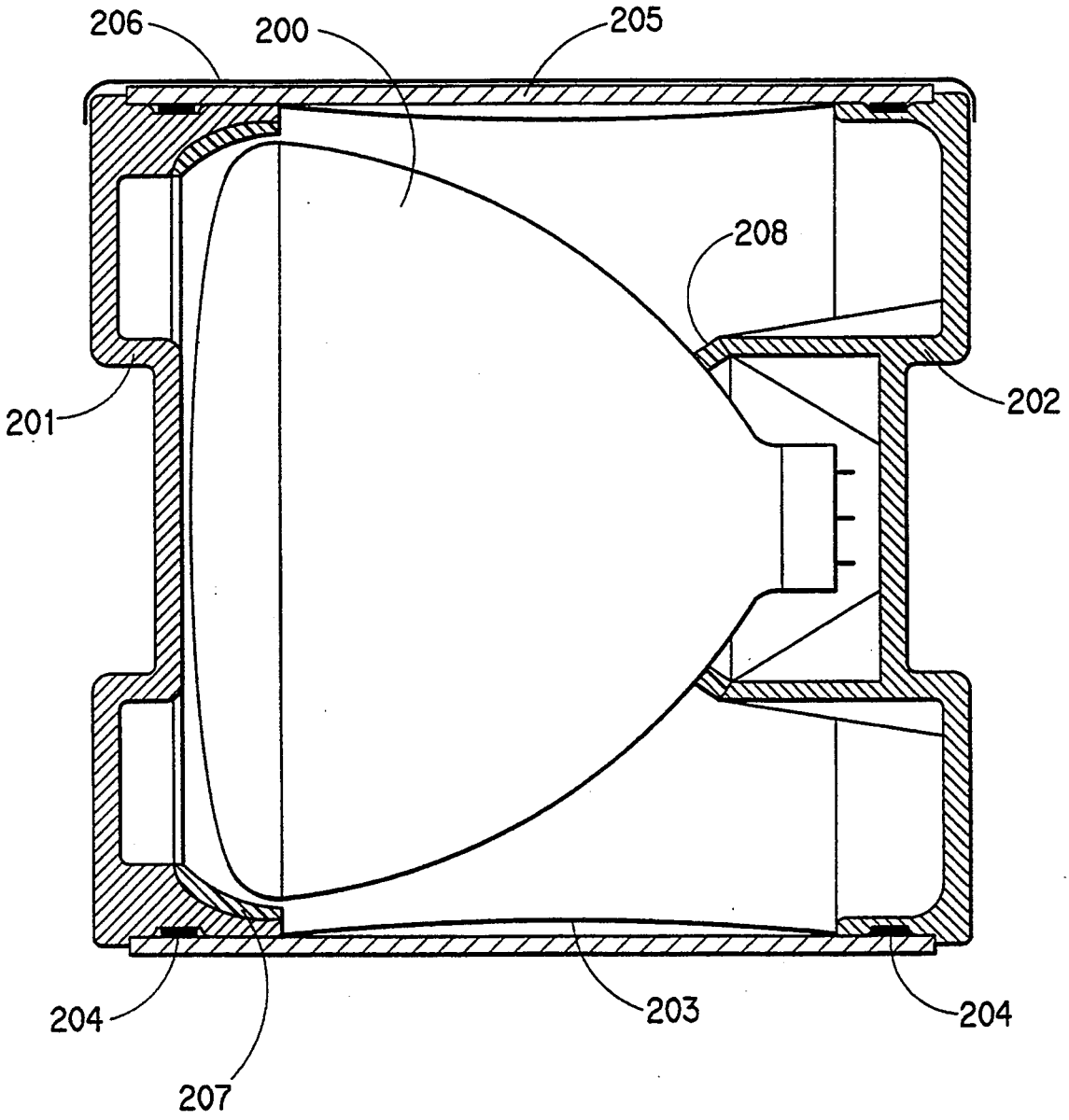
FIG. 10 is a longitudinal cross-section of a package for a television picture tube.

An example of how the invention may be used packaging a television imaging tube is represented in FIG. 10. Two different end pieces (201, 202) are provided because of the asymmetry of the object (200). A shrink film tubing (203) is secured to the two end pieces (201, 202 ) and tensioned between them. The end pieces (201, 202) are supported by a sheath (205) which, in this configuration, serves as a support component. Because of the strength required, it is bent from a rectangular plate of plastic with embossed crease points, and sealed with the adhesive tape (206). Areas of the end pieces (201, 202) that are in contact with the packaged tube have rings (207, 208) of elastic material, adhered to the end pieces (201, 202). The stress from the tensioned film tubing (203) is thus absorbed chiefly by the sheath (205), and cannot damage the tube.

The present invention provides a package with a support extending axially to the object, and two end pieces positioned on the ends of the support and projecting beyond the cross-section of the object. The package includes an envelope, for fixing the end pieces in their position, comprising a tensioned tubular film joined with the end pieces. With this configuration, the only operations needed for making the package of the invention are positioning the end pieces, applying the film, e.g., by slipping it on, tensioning, and joining the tubing with the end pieces. This sequence of operations can be automated at reasonable cost. Essentially, a box is no longer needed to fix the end pieces in position. The end pieces and even the support can be so configured that after the object is unpacked they are not bulky, and can be re-used. Adapting to objects of different length is especially simple, requiring only a change in length of the tubular film and, if necessary, that of the support.

The end pieces must be so configured that their axial projection has the form of a polygon with, if appropriate, rounded but not concave corners, or the form of a closed, unidirectional curved line, e.g., a circle or an ellipse. This gives the package of the invention approximately the form of a prism; and because of the tension of the film a certain necking in may occur at the center. A square, rectangular or circular configuration of the end pieces is preferred because production of such packages is easy to automate, and they can be stacked in multiple package units, e.g., on pallets. The tensioned film and the end pieces are advantageously joined by positive or adhesion joints. In this way, after the object is taken out of the package, the end pieces are re-usable without further processing. The end pieces are preferably shaped so that, in the finished package, exterior surfaces have depressions or other appropriate shapes for manual or mechanical handling.

In one preferred version of the invention, the package is enclosed within a sheath made from a rectangular, flat, sheet or plate-shaped blank by creasing or bending and joining the edges together. Joining is advantageously by adhesion. The sheath protects the film and the packaged object from mechanical damage, e.g., in stacking a relatively large number of individual packages. The length of this sheath corresponds to the width of the blank, and is greater than the free space between the end pieces; but it may be less than the overall dimension measured over the end pieces. Because of their simple shape, such blanks can be cut to size as needed immediately prior to the packaging procedure; and expensive storage of pre-made parts, for example boxes, can be dispensed with.

The support on which the end pieces rest may be fashioned in different ways. If the object to be packaged has adequate axially-oriented strength, a version is preferred in which the object itself assumes the function of the support. In this event, additional suitable adapters can be inserted between the object and the end pieces for shape conforming. The support may also extend through an axial aperture in the object, or it may be situated between the object and the film. Finally, the outer sheath may also assume the function of the support when the end pieces rest on its ends.

Tension can be easily generated in the tubular film if, in making the package, it is elongated under tension before joining it with the end pieces. In one preferred version, a shrink film is thermally shrunk and thus tensioned after it is slipped over the object-end pieces assembly and after joining with the end pieces. The tensioning stress should be such that it suffices to fix the end pieces securely on the support under the stresses expected, but does not overload it.

In one preferred version of the invention, the film may be joined with the end pieces by peripheral tapes that secure the film on the periphery or in a groove of the end pieces and thus create a flexible union of film and end piece. In another preferred version, a positive union between a shrink film tubing and an end piece is created by means of a peripheral groove; after the tubular film is slipped on, it is heated in this zone, and shrinks into the groove. This groove is rectangular or triangular in shape. Stability of the positive union is further enhanced if the groove has peripherally extending channels or elevations.

Depending on the stability required, the edge areas of the blank from which the outer sheath is made may, after creasing or bending, overlap or meet in butt configurations. They are advantageously adhered with an adhesive tape, which may project out beyond the sheath and secure it to the end pieces. Overlapping edge areas may also be adhered by means of an adhesive. The end pieces may also have additional peripheral recesses in which the sheath is positioned. Depth of such recesses may, for example, equal the thickness of the sheathing material, so that the sheath is joined flush with the end piece. In this manner, the sheath positioned in the recesses is axially secured. If the sheath material is thicker it protrudes and, when the packages are stacked, prevents contact between the end pieces of differing packages. This ensures that the stresses imposed by weight do not move the end pieces on the packaged articles and damage them.

Other preferred versions of the invention involve packages for more than one object. Relevant to their axis, these may be arranged in sequence, or side by side. In the former, spacers are provided between the sequentially arranged objects. The inner ends of the supports acting on each individual object rest on the spacers; the outer ends, i.e., those facing the package, rest on end pieces, as in packages for individual objects. The spacers may have a peripheral edge supporting the tubular film and, where relevant, the outer sheath.

If similar Objects are to be arranged side by side in a common package of the invention, multiple end pieces are provided. These are configured to accept the ends of the supports of all the objects to be packaged. As in the individual package, a tubular film is tensioned between the multiple end pieces and secured to them. In this event as well, it is advantageous also to have an outer sheath. If the supports of the objects to be packaged together are not of uniform length, the difference in length between the longest and the shorter supports can be compensated for by placing equalizers between the shorter supports and one of the multiple end pieces.

The tubular film enveloping the package of the invention may consist of thermoplastic polymers, e.g., polyethylene or polypropylene. Multilayer films with, if appropriate, a barrier layer, e.g., for water or oxygen, or metallized films may be used. The polymer layers may also contain chromophores. The end pieces and spacers in the package of the invention advantageously are of plastic, wood, cardboard or metal. Thermoplastics, e.g., polyethylene, polypropylene, polyvinyl chloride, polystyrene, and acrylonitrile-butadiene-styrene copolymers are suitable, as are thermosets such as phenol formaldehyde resins. Composites of the said components may also be used.

The material of the sheath that may cover the package of the invention must have a certain stiffness, to permit stacking a number of individual packages without deforming sheath and envelope, which would exert stress on the packaged objects. As examples, cardboard that also may be multilayered or metallized, plastics, e.g., thermoplastics such as polyethylene, polypropylene, polyvinyl chloride, polystyrene, ABS copolymers, metal sheeting or also metallized plastic materials are suitable. Especially if the sheath serves as a load-bearing support, plastic sheet of adequate thickness or metal sheeting is preferred. It is advantageous to provide the blank used for making the sheath with pre-formed crease sites, e.g., grooves in cardboard or so-called plastic hinges.

To meet the objective of creating a package that after use leaves minimum waste, the tubular film and sheath preferably consist of recyclable types of the materials cited. Sheaths of adequate strength may also be used more than once; they may be laid flat to save space in return shipments.

Generally, it is desired to have product description data or a promotional message on the package. In the package of the invention, general information about the manufacturer or type of product may advantageously be permanently applied on the reusable end pieces. Information concerning the individual packaged object is printed on the sheath that will be recycled.

If the objects to be packaged are light-sensitive, e.g., photo-recording materials, it is advantageous to use a material impermeable to light for the end pieces and the tubular film. Objects that may be damaged by humidity are advantageously packaged with the package of the invention using for the film a material that does not transmit water vapor. A siccative, e.g., silica gel, may also be put into the cavity formed by the object, the end pieces and the film, and secured to an end piece by a holder.

The package of the invention is particularly suited for materials in the form of webs that are in roll format. In such cases, the core can assume the function of the support member. The end pieces in contact with the ends of the core can stabilize the roll against telescoping; if appropriate, disks of an elastic material can be situated between the front sides of the roll and the end pieces. A direct, fixed union of the core with special end disks is no longer necessary for stabilizing the roll. This means that when the object is unpacked the end pieces can be easily removed without damage and can be reused. This last-mentioned version of the invention is especially advantageous for packaging light-sensitive materials in roll format, e.g., silver halide films or photopolymer films.

What is claimed is:

1. A package for an object, comprising a support component extending axially to an object, two end pieces resting, respectively, on the ends of the support component and each end piece having a circumference projecting beyond the cross-section of the object, and a tensioned tubular film joined with the end pieces to create a union therewith and fix the end pieces in their position, characterized in that the tubular film is attached in grooves or recesses encircling the circumference of the end pieces by a positive or a frictional joint.

2. Package as in claim 1 characterized in that the exterior of said package is enveloped within a sheath created from a rectangular flat blank by creasing or bending and adhering.

3. Package as in claim 2, characterized in that the support component-penetrates an axial aperture of the object.

4. Package as in claim 2, characterized in that the support component is represented by the object itself, in conjunction with adapters.

5. Package as in claim 2, characterized in that the end pieces are in contact, respectively, with ends of the sheath as a support.

6. Package as in claim 2, characterized in that the tubular film is a shrink film that has been tensioned by thermal shrinking.

7. Package as in claim 6, characterized in that the end pieces have recesses into which the shrink film sinks during said thermal shrinking.

8. Package as in claim 7, characterized in that the end piece recesses have channels or ridges that are likewise peripheral, to enhance the frictional union of the shrink film therewith.

9. Package as in claim 2, characterized in that the tubular film is secured to the end pieces by circumferential tapes.

10. Package as in claim 2, characterized in that said adhering is done with an adhesive tape.

11. Package as in claim 10, characterized in that the adhesive tape also adheres the sheath to the end pieces.

12. Package as in claim 2, characterized in that the sheath is inserted into a recess of the end pieces.

13. Package as in claim 2, characterized in that it contains two or more objects arranged axially one behind the other in a common envelope, and opposing ends of the support components rest on spacers, and the end pieces rest on the outer ends of the support components.

14. Package as in one of claim 2, characterized in that it contains two or more objects arranged side by side in a common envelope, and the support components terminate in multiple end pieces.

15. Package as in claim 2, characterized in that the end pieces have depressions making mechanical or manual handling possible.

16. Package as in claim 2, characterized in that the end pieces and spacers are of plastic, wood, metal, cardboard or composite materials.

17. Package as in claim 2, characterized in that the sheath consists of plastic, cardboard, metal, or a composite.

18. Package as in claim 2, characterized in that the material of the tubular film and the sheath is recyclable.

19. Package as in claim 2, characterized in that the material of the tubular film is impermeable to light.

20. Package as in claim 2, characterized in that the material of the tubular film is impermeable to water vapor, and the package contains a siccative.

21. Package as in claim 2, characterized in that the object is a web-configured material on a roll.

22. Package as in claim 21, characterized in that the object is a roll of silver halide film or photopolymer film.

23. Package as in claim 21, characterized in that elastic disks are located between the end pieces and the faces of the roll.

* * * * *